United States Patent [19]

Baker, Jr.

[11] 4,134,948

[45] Jan. 16, 1979

[54] METHOD OF MAKING A NONWOVEN FABRIC

[75] Inventor: John H. Baker, Jr., Philadelphia, Pa.

[73] Assignee: Scott Paper Company, Philadelphia, Pa.

[21] Appl. No.: 569,232

[22] Filed: Apr. 16, 1975

Related U.S. Application Data

[60] Continuation of Ser. No. 279,691, Aug. 10, 1972, abandoned, which is a division of Ser. No. 23,751, Mar. 30, 1970, abandoned.

[51] Int. Cl.[2] ..... B29C 17/04

[52] U.S. Cl. ..... 264/518; 156/209; 156/220; 156/296; 162/115; 162/117; 162/136; 162/231; 428/171; 264/119; 264/557; 264/121; 264/122; 264/128; 264/129

[58] Field of Search ..... 156/219, 220, 180, 181, 156/209, 296; 428/156, 174, 171, 198; 264/129, 284, 293, 91, 119, 121; 427/294, 288, 276, 278; 162/109, 115, 117, 136, 184, 231; 101/32, 170

[56] References Cited

U.S. PATENT DOCUMENTS

| | | | |
|---|---|---|---|
| 2,128,516 | 8/1938 | Graham | 8/151 |
| 3,059,313 | 10/1962 | Harmon | 156/183 |
| 3,395,201 | 7/1968 | Kalwaites | 264/45 |
| 3,533,834 | 10/1970 | Marzocchi | 118/50 |
| 3,616,157 | 10/1971 | Smith | 428/171 |
| 3,850,095 | 11/1974 | Snyder | 101/32 |

FOREIGN PATENT DOCUMENTS 1071191 6/1967 United Kingdom.

*Primary Examiner*—Stanley S. Silverman
*Attorney, Agent, or Firm*—Martin L. Faigus; William J. Foley

[57] ABSTRACT

A nonwoven, self-sustaining, absorbent fabric comprising a batt of randomly arranged, intermingled cellulosic fibers has a plurality of high loft, loosely compacted regions separated from each other by highly compressed regions. An adhesive material penetrates through the compressed regions to form bonded fiber networks extending completely through the batt, and said adhesive material only partially penetrates through said high loft regions whereby the fibers in the interiors of said high loft regions are unbonded by said adhesive so that said regions are highly absorbent. A method of manufacturing the above-described nonwoven fabric by moistening opposed surfaces of a loosely compacted, randomly oriented cellulosic fiber batt, embossing said moistened batt for providing a pattern in said surfaces, applying an adhesive to the patterned surfaces of the batt and setting said adhesive.

5 Claims, 3 Drawing Figures

METHOD OF MAKING A NONWOVEN FABRIC

This is a continuation, of application Ser. No. 279,691, filed Aug. 10, 1972, now abandoned which is a division of application Ser. No. 23,751, now abandoned filed Mar. 30, 1970.

BACKGROUND OF THE INVENTION

1. Field of the Invention

This invention relates to a method of manufacturing a nonwoven fabric constituting a substitute for a textile fabric, and to the product manufactured thereby. More specifically, this invention relates to a method for manufacturing a disposable, randomly arranged, intermingled cellulosic fiber batt which has sufficient strength and absorptive capacity to serve as a disposable textile replacement fabric for industrial wipers, household wipers, and the like, and to the product produced thereby.

2. Description of the Prior Art

Considerable effort has been devoted to providing inexpensive, disposable, nonwoven fabrics to be used as a substitute for textile fabrics. Such a fabric is particularly desirable for use as an industrial or household wiper, wherein disposability has become an attractive feature. To meet market demands in this field, the disposable fabric must be absorbent, strong in both the wet and dry state, capable of retaining liquids, and low cost. From an economical standpoint, one of the most attractive approaches in fabricating a nonwoven textile replacement fabric is to incorporate a substantial amount of wood pulp fibers into the fabric. Although an untreated wood pulp batt is highly absorbent, it unfortunately possesses low cohesive strength in both the wet and dry state, low forces of capillary attraction, and an inadequate ability to retain fluids which are absorbed.

In U.S. Pat. No. 3,017,304 Burgeni discloses applying controlled amounts of moisture to the surface of a wood pulp batt, or web, and thereafter applying pressure within controlled limits to form a densified, highly compacted cellulosic fibrous layer which is integral with the remainder of a loosely compacted, fibrous absorbent body of the web. This treatment increases the cohesive strength of the batt, increases the capillary forces in the batt and enhances the fluid retentivity of the batt. Although this treatment may be adequate for applications wherein the batt is wrapped in an outer protective, or stabilizing cover, it is not adequate to produce a product having the strength, stability and durability to be considered a self-sustaining substitute for conventional textile fabrics utilized as household wipers, industrial wipers, and the like.

British Pat. No. 401,149 discloses a process for producing a nonwoven material having the properties of deerskin, in which loose cotton fibers are formed into a fleece strip which is laid in a zig-zag arrangement on a reciprocating table, one layer on top of another, until a sufficiently thick structure is obtained, alternate layers being arranged cross-wise. The structure is then wetted and pressed in a calender, after which a binder having an india rubber emulsion containing vulcanizing ingredients as a base and being suitably colored, is sprayed onto the structure under pressure. The structure is then oven dried, until vulcanization sets in and completes the process. The above-described process produces a leather-like material which does not possess the absorptive rate or capacity characteristics to permit its use as a substitute for a textile fabric in household and industrial wiping applications.

In U.S. Pat. No. 2,955,962 Engdahl discloses a nonwoven dust cloth which is made from either 100% viscose rayon fibers or 40% thermoplastic cellulose acetate fibers and 60% non-thermoplastic viscose fibers. These dust cloths have an extremely low basis weight, i.e., on the order of one-half oz/yd$^2$, and will not possess the absorptive capacity desired for use as household or industrial wipers. Additionally, the dust cloths disclosed in the Engdahl patent are manufactured from a substantial percentage of viscose rayon textile fibers, and therefore, the resulting product is considerably more expensive than one containing a substantial amount of wood pulp fibers in lieu of rayon textile fibers.

SUMMARY OF THE INVENTION

The nonwoven, self-sustaining, absorbent fabric of this invention consists of an air-laid, randomly arranged, intermingled cellulosic fibrous batt which has a plurality of high loft regions separated from each other by highly compressed regions of narrow width. An adhesive bonding material penetrates through the batt in the compressed regions to form bonded networks extending through opposed surfaces of the batt. The adhesive bonding material only partially penetrates through the high loft regions to form adhesive layers, whereby the interior of said high loft regions comprises unbonded, highly absorbent fibers. The penetration of the adhesive through the highly compressed regions prevents the fabric from delaminating, and also provides sufficient tensile strength to the fabric to permit said fabric to withstand continuous usage under rigorous conditions often encountered in household and industrial uses. The highly compressed regions have high capillary forces which aid in transmitting fluids along the fibrous structure, and the unbonded interiors of the high loft regions provide high capacity regions for storing such fluids. The adhesive layers which penetrate partially through the high loft regions stabilize the outer surface of the fibrous batt and prevent linting, or dusting thereof during use. The nonwoven fabric preferably contains approximately 75% wood pulp fibers and approximately 25% synthetic cellulosic fibers, such as high wet strength rayon fibers. The longer synthetic fibers are desirable to strengthen the batt.

The absorbent, nonwoven fabric of this invention is manufactured by feeding an air-laid batt comprising approximately 75% wood pulp fibers and approximately 25% rayon fibers past a moistening station at which the batt is sprayed with moisture on opposite flat surfaces thereof. The moistened batt is passed through heated embossing rolls which form an embossed pattern in the batt comprised of a plurality of highly compressed, narrow regions separating a plurality of high loft regions. After the embossed pattern has been formed in the batt, edge seals in the cross-direction and machine direction of travel of the batt, are embossed in the batt, and the batt is then passed through two adhesive applying stations. At the first adhesive applying station the adhesive is sprayed upon one embossed surface of the batt, and a suction, aligned with the adhesive spray, is pulled through the opposed surface of the batt. The sheet is then turned as it is fed to the second adhesive applying station, and adhesive is applied to the opposed surface of the batt while a suction is pulled through the batt from the side thereof which was first sprayed with adhesive. The adhesively sprayed batt is then conveyed to a heated oven wherein the moisture is driven off and the adhesive is cured.

It is an object of this invention to provide a nonwoven, self-sustaining, absorbent fabric comprising an embossed batt of randomly arranged, intermingled cellulosic fibers in which the embossed pattern defines a plurality of highly compressed regions having an adhesive network disposed therethrough, and a plurality of high loft regions having an adhesive layer extending from the outer surfaces partially through the batt whereby a portion of the interiors of the high loft regions remain unbonded.

It is a further object of this invention to provide a nonwoven, self-sustaining, absorbent fabric comprising an embossed batt of randomly arranged, intermingled cellulosic fibrs consisting of over 50% wood pulp fibers.

It is a further object of this invention to provide a nonwoven, self-sustaining, absorbent fabric comprising an embossed batt of randomly arranged, intermingled cellulosic fibers which is comprised of approximately 75% wood pulp fibers and approximately 25% rayon fibers.

It is a further object of this invention to provide a method for manufacturing a nonwoven, self-sustaining, absorbent fabric in which a surface of a randomly arranged, intermingled cellulosic fibrous batt is moistened, embossed, sprayed with adhesive, and set.

It is a further object of this invention to provide a method of manufacturing a nonwoven, self-sustaining, absorbent fabric wherein opposed surfaces of a batt of randomly arranged intermingled cellulosic fibers are sprayed with water prior to embossing.

It is a further object of this invention to provide a method for manufacturing a nonwoven, self-sustaining, absorbent fabric in which opposed surfaces of a batt of randomly arranged, intermingled cellulosic fibers are embossed with like patterns.

It is a further object of this invention to provide a method for forming a nonwoven, self-sustaining, absorbent fabric in which opposed surfaces of an embossed batt of randomly arranged, intermingled cellulosic fibers are sprayed with adhesive.

It is a further object of this invention to provide a method for manufacturing a nonwoven, self-sustained, absorbent fabric in which adhesive is applied to opposed surfaces of a fibrous batt at adjacent adhesive-applying stations, and a suction is pulled through the batt at each adhesive-applying station, from the side of the batt opposite the side receiving the adhesive application.

Other objects and advantages of the present invention will be readily understood by referring to the detailed description which follows taken in conjunction with the drawings.

DESCRIPTION OF THE PREFERRED EMBODIMENTS

Figure 1:
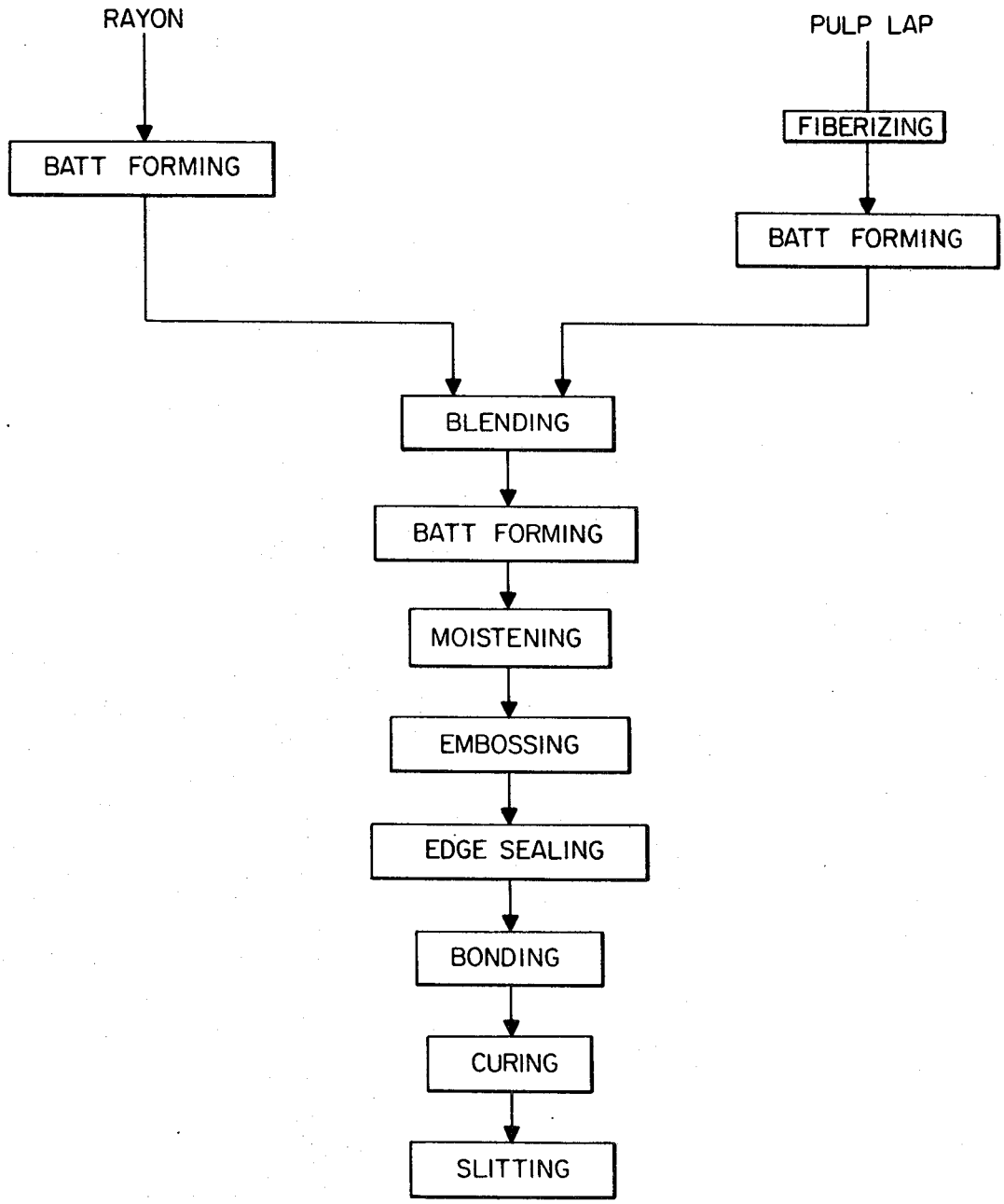
FIG. 1 is a flow chart representing the sequential steps employed in manufacturing the nonwoven fabric of this invention.

The method of manufacturing the nonwoven, self-sustaining, absorbent fabric of this invention can best be understood by referring to the process flow chart of FIG. 1. Baled rayon is fed through a rayon opening step. Any suitable rayon opening equipment can be utilized; however, in the preferred embodiment of the invention the baled rayon is fed through a Rando Prefeeder, which opens the rayon slightly, and then through a Rando Opener-Blender, which completes the opening operation. Both the Rando Prefeeder and Rando Opener-Blender are manufactured by the Curlator Company of Rochester, N.Y. The opened rayon is then fed through a chute feed in which the opened rayon is formed into a fibrous batt. One chute feed which has been found to be satisfactory is the CMC-Evenfeed manufactured by CMC Corporation, of Charlotte, N. C.

Pulp lap is fiberized by passing a continuous roll of pulp lap through a fiberizer which defibers the wood pulp and forms the defibered wood pulp into a loosely compacted fibrous batt. In the preferred embodiment of the invention a Joa fiberizer is utilized; however, other fiberizers, such as a hammermill or disk defiberizer, can also be utilized. The Joa fiberizer is manufactured by Joa, Inc. of North Wales, Florida.

The rayon batt from the chute feed and the wood pulp batt from the fiberizer are fed through a blending step which is accomplished by feeding both batts into a precarder which intimately blends the rayon and wood pulp fibers together. The process is controlled such that approximately 75% wood pulp fibers are mixed with approximately 25% rayon fibers in the blending step. The blended fibers are then fed through a Rando Feeder and Rando-Webber which forms an air-laid fibrous batt from the blended fibers. The Rando Feeder and Rando-Webber are manufactured by the Curlator Company.

The Rando Feeder takes the blended wood pulp-rayon fibers and forms a feed mat which is directed into the Rando-Webber. The mat is fed into the Rando-Webber and is engaged by pins of a rotating likerin roll which combs individual fibers from the feed mat, and the fibers are carried in an air stream into a venturi which has a cross-sectional area increasing in the direction of flow of the fibers whereby the speed of the air borne fibers is decreased as the fibers flow toward a condenser screen upon which a fibrous batt is formed. The Rando-Webber is controlled to produce a fibrous batt having a basis weight of approximately 3.5 ounces per square yard, and a moisture level of approximately 9.5% regain.

After the batt is formed on the condenser roll of the Rando-Webber, it is taken off by a foraminous conveyor for feeding the web to a moisture-applying station. At this station water is sprayed onto opposite surfaces of the batt by either a pneumatic or hydraulic flat spray setup, which gives adequate water coverage on the web. In the preferred method of formation a total of approximately 35% moisture add-on (above regain value), by weight, is added to the batt. Excessively low moisture levels usually result in poor pattern definition, and therefore a decrease in peel strength. Excessively high moisture levels result in lower absorbency capacity in the finished product.

The moistened batt is then fed to the embossing station which is comprised of a rigidly mounted pattern roll and a spring mounted pattern roll defining a nip therebetween. The spring mounted roll is capable of being loaded to provide the desired embossing pressure to the moistened web.

In the preferred embodiment of the invention, a batt having a width of approximately 40 inches is fed through the nip of embossing rolls having land areas defining approximately 30% of the surface area of the rolls, and approximately 7000 pounds total load is applied to the rolls. The embossing pressure should be sufficient to insure that pattern clarity is obtained, but should not be excessive to cut through, or weaken the batt. The embossing rolls have aligned land areas and aligned root areas, whereby the regions of the batt which are confined between aligned land areas are rigorously compressed to define narrow highly compressed regions, and the regions of the batt aligned between opposed root sections are compressed only slightly to define high loft regions. If desired, the embossing rolls can be heated by hot oil, or other suitable heating fluid passing through the core thereof, and in the preferred embodiment of this invention the rolls are heated in the range of approximately 155° F.–170° F.

The temperature of the embossing rolls can be varied depending upon the particular embossing pressure imposed on the sheet, i.e., lower temperatures can be used with increasing pressures. In addition, various percentages of moisture add-on can be utilized, depending on the pressure-temperature parameters of the embossing step, i.e., lower percentages of moisture can be utilized by increasing the embossing pressure and temperature. The moisture level of the batt must be sufficient to insure that the batt will retain its embossed pattern during subsequent operations. In some instances the fibers which are utilized may be capable of retaining an embossed pattern without any moisture addition.

After embossing, the nonwoven fabric is passed to an edge sealing station which comprises two sets of edge sealing rolls. One set of rolls have aligned raised portions for providing cross direction edge seals extending across the width of the web. The other set of rolls have aligned raised portions for providing machine direction seals on the batt, to thereby divide the batt into a series of nonwoven fabrics which will be separated from the batt by slitting means at the end of the fabric forming process. If desired, the edge sealing operation can be performed at the end of the fabric forming process, i.e., after adhesive setting.

After the batt has been edge sealed in both the cross direction and machine direction, it is sequentially fed by foraminous conveyors past two adhesive-applying stations. At the first station, one surface of the web (the surface which is unsupported by the conveyor) is sprayed with an adhesive, and a partial vacuum is applied through the conveyor and nonwoven batt in alignment with the adhesive spray, and from the side of the batt which is not being adhesively sprayed. The application of a vacuum increases the penetration of adhesive into the batt and reduces backsplash and adhesive drift to thereby reduce binder waste. After the web has been sprayed on one side thereby, it passes to another conveyor in a manner such that the sprayed side of the web is supported by the second conveyor, and the unsprayed side of the web is facing upwardly therefrom. An adhesive spray is applied to the unsupported surface, and a partial vacuum is drawn through the web from the opposite side thereof in the manner, and for the reasons set forth with respect to the description of the first adhesive-applying station.

The adhesive which is preferably applied to the batt is a cross-linkable acrylic latex. One such binder formulation which is suitable for producing a solvent resistant, nonwoven fabric, comprises 90% of a hard adhesive, such as HA-8, which is an acrylic Rhoplex binder sold by Rohm & Haas, and 10% of K-3 which is a soft adhesive acrylic Rhoplex binder which is also sold by Rohm & Haas. The large quantity of hard adhesive relative to soft adhesive is required to insure high tensile strength in the nonwoven structure. One recommended adhesive formulation for producing the product of this invention consists of the following percentages by weight:

23.52 Rhoplex HA-8 at 46% solids
2.60 Rhoplex K-3 at 46% solids
73.20 $H_2O$
0.50 $NH_4Cl$ (catalyst)
0.18 Triton GR5 (wetting agent)

The above-described adhesive formulation is applied by pumps through spray guns. In a preferred embodiment of this invention approximately 11% total adhesive solids add-on by weight is utilized, with 50% of this quantity being added at each of the two adhesive spray stations. The quantity of adhesive add-on is regulated by air pressure, nozzle size, and speed of the conveyed batt of nonwoven material. A 0.009 inch flat spray nozzle gave 11% adhesive add-on at a batt speed of 20 feet per minute. After the adhesive has been applied to the batt, the batt is conveyed to a heating chamber for drying the batt and subsequently curing the adhesive, i.e., completing the cross-linking reaction. The oven temperature for drying and curing are maintained preferably at approximately 300° F. In the event that adhesives other than cross-linkable binders are utilized, the batt will be subjected to an adhesive setting process appropriate for the particular adhesive being utilized.

After the drying and curing operation, the individual nonwoven fabrics are separated from the batt by slitting the batt midway along edge sealed regions thereof.

The rayon utilized in the nonwoven fabric of this invention is a high wet modulus rayon fiber. Although regular tenacity, and high tenacity-high elongation rayon could be utilized in the nonwoven fabric, nonwoven fabrics made from high wet modulus rayons were observed to be approximately 30% stronger in machine direction and cross-direction dry tests and from between 35% and 40% stronger in machine direction and cross-direction wet tests. Cotton fibers were considered; however, the necessity of providing a bleached cotton to remove impurities presented a cost obstacle to the use of cotton, and also, the cotton fibers did not produce a nonwoven fabric having the tensile properties necessary for rigorous wiping applications. It is possible that cotton could be utilized in a nonwoven structure of this invention wherein the structure is subjected to light applications, i.e., not heavy industrial uses.

In the preferred embodiment of this invention the textile fiber utilized with wood pulp in making the nonwoven, self-sustaining, absorbent fabric of this invention is a high wet modulus rayon, having a denier ranging from 1.5 to 3.0 and a length ranging from 1-9/16 inches to 2 inches. The preferred rayon fiber for use in the nonwoven fabric is a 1.5 denier, 1-9/16 inch high wet modulus rayon. Other fibers such as polyamide or polyether-type fibers may also be utilized in the nonwoven fabric of this invention.

It is highly desirable to utilize a major portion of wood pulp fibers in the nonwoven fabric of this invention, since wood pulp is relatively inexpensive as compared to the cost of longer textile fibers, such as rayon and cotton, and wood pulp has excellent absorbency characteristics. In order to insure the uniform defiberation of the wood pulp, a debonder, such as Velvetol, manufactured by Quaker Chemical Company, may be added to the wood pulp lap.

Although a precarder is utilized to blend the wood pulp and rayon fibers, it is within the scope of this invention to blend the wood pulp and rayon fibers in the Rando Feeder although utilizing the Rando Feeder as the blending means for the fibers imposes extreme speed limitations on the manufacturing operation. Optimum results have been obtained by using a precarder to blend the fibers in proper proportion prior to feeding the blend into the Rando Feeder.

Figure 2:
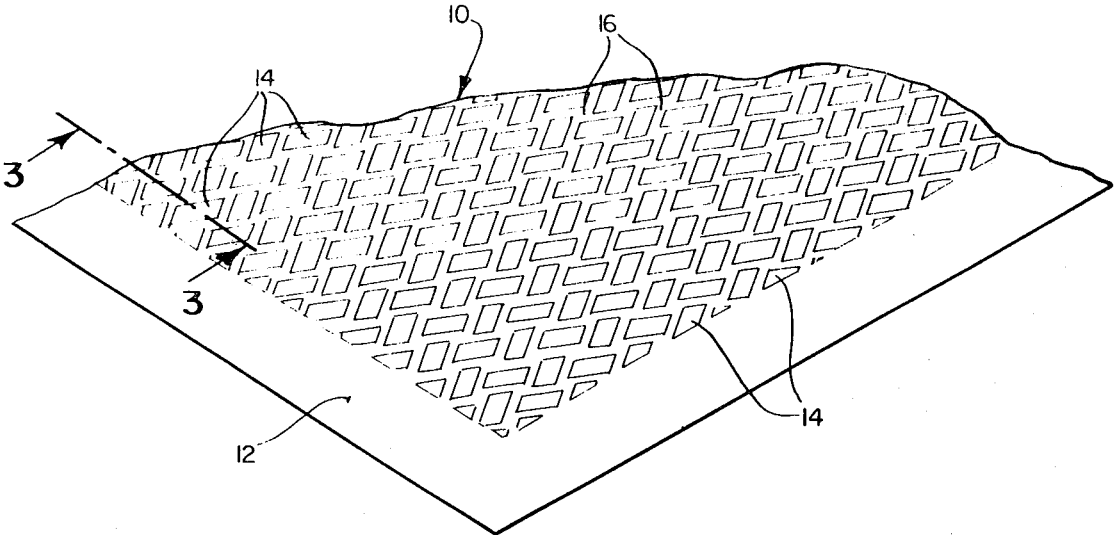
FIG. 2 is a perspective view of a nonwoven fabric of this invention.
Figure 3:
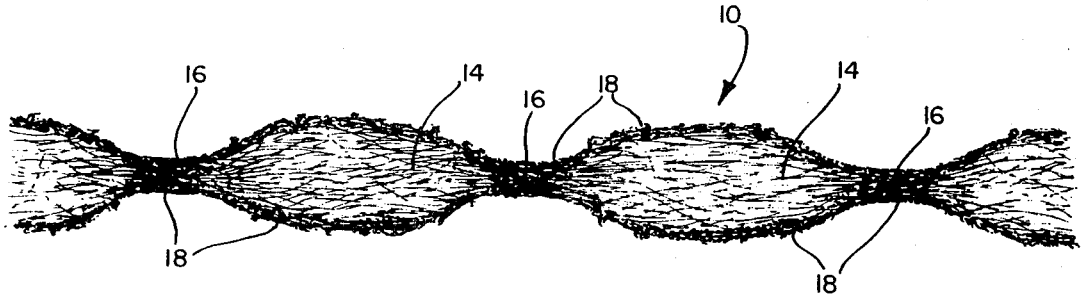
FIG. 3 is a sectional view taken along line 3—3 of FIG. 2 showing the adhesive distribution in the fabric.

Referring now to FIGS. 2 and 3, the product manufactured according to the above-described method will now be discussed. The nonwoven fabric 10 of this invention has a bone dry weight of approximately 3.6–3.7 ounces per square yard, which is equivalent to a regain (approximately 8%) weight of 4 ounces per square yard. The fabric 10 is approximately 12.25 inches wide and 14 inches long; however, these dimensions can be varied. The fabric consists of an edge sealed region 12, a plurality of high loft regions 14 separated by a plurality of highly compressed narrow regions 16. In the preferred embodiment of the invention the high loft regions comprise approximately 70% of the embossed surface area (excluding the edge sealed region) of the fabric. Referring to FIG. 3, it is evident that adhesive 18 forms a layer that partially penetrates the high loft regions and coats the upper surface of the fabric to prevent dusting or linting thereof. The interior portion of the high loft regions remain unbonded to provide excellent fluid storage areas whereby the product has excellent absorptive capacity characteristics.

The adhesive 18 forms a bonded network through the nonwoven fabric in the highly compressed, narrow regions 16. The description of the bonding pattern as a "network" in the highly compressed regions is intended to define the condition wherein all the fibers in a compressed region are bonded together, as well as the condition wherein some of the fibers are not bonded to others, but wherein a continuous bonded fiber path can be traced between the opposed surfaces of the batt. The bonded network provides the fabric with a high peel strength to prevent the fabric from delaminating or splitting apart during use. In addition, the bonded network enhances the tensile strength of the product.

What is claimed is:

1. A method of manufacturing a nonwoven, self-sustaining absorbent fabric having the requisite cohesive strength, flexibility, absorbency and abrasion resistance to render it usable as a replacement for textile fabrics, said method including the sequential steps of:

(a) forming an air-suspension of fibers, over 50% of said fibers being the wood pulp fibers;

(b) directing said air-suspension of fibers toward an air-permeable forming surface to cause the air to pass through said forming surface and to deposit the fibers of said suspension on the forming surface in the form of a low integrity sheet of fibers disposed in a randomly arranged and intermingled fashion, said sheet having opposed major surfaces;

(c) adjusting the moisture level of the dry formed sheet so that it will retain an embossed pattern therein;

(d) embossing the sheet in a manner so as to form a plurality of spaced, highly compressed valley regions and spaced, high loft regions such that a quantity of adhesive, which, when applied to opposed surfaces of the sheet so as to leave interior portions of the high loft regions unbonded, will form adhesive networks extending completely through the sheet in the highly compressed valley regions, said embossing step forming the highly compressed valley regions and high loft regions over substantially the entire extent of said sheet;

(e) applying said quantity of adhesive to the opposed major surfaces of the embossed sheet in a manner (1) for interconnecting surface fibers of the sheet to stabilize substantially all of said surface fibers, (2) for forming adhesive networks extending completely through the sheet over substantially the entire extent thereof in the highly compressed valley regions to enhance the peel and tensile strengths of said sheet, and;

(3) for forming bonded regions which partially penetrate through the sheet in the high loft regions to leave interior portions of said high loft regions unbonded by said adhesive and highly absorbent; and (f) drying the sheet and setting the adhesive.

2. The method of claim 1 including forming the air-suspension of fibers with the wood pulp fibers and longer reenforcing fibers to form the low integrity sheet with randomly arranged and intermingled wood pulp and longer reenforcing fibers.

3. The method of claim 1 wherein the embossing step is carried out so that the opposed surfaces of the high loft regions constitute the outermost boundaries of the sheet.

4. The method according to claim 1, wherein said adhesive is applied to opposed surfaces of the sheet by spraying an adhesive on each of said surfaces, and applying a vacuum to the sheet in alignment with the adhesive spray from the side of the sheet opposite the surface being sprayed.

5. The method according to claim 4, wherein the step of embossing the sheet is accomplished by passing the sheet through a nip defined by opposed embossing rolls having land areas thereon disposed in substantially the same pattern so as to be in alignment with each other in the nip region, whereby said opposed surfaces of said sheet are embossed with like patterns.

* * * * *